United States Patent [19]

Smith

[11] Patent Number: 5,037,339

[45] Date of Patent: Aug. 6, 1991

[54] FORWARD FACING ROWING MECHANISM

[76] Inventor: Jack R. Smith, 9910 Brick Rd., Norwich, Ohio 43767

[21] Appl. No.: 513,444

[22] Filed: Apr. 23, 1990

[51] Int. Cl.[5] ..... B63H 16/04

[52] U.S. Cl. ..... 440/102; 416/74

[58] Field of Search ..... 440/101-106, 440/13, 17; 416/70 R, 69, 74, 79-83; D12/215

[56] References Cited

U.S. PATENT DOCUMENTS

| | | | |
|---|---|---|---|
| 538,081 | 4/1895 | McFarland | 440/102 |
| 587,639 | 8/1897 | Boerger | 416/74 |
| 1,540,695 | 6/1925 | Howard | 440/103 |
| 4,738,643 | 4/1988 | Noggle | 440/103 |

*Primary Examiner*—Ed Swinehart

*Attorney, Agent, or Firm*—Renner, Kenner, Grieve, Bobak, Taylor & Weber

[57] ABSTRACT

A forward facing rowing mechanism (10) for a boat (11) having a bow (12), a longitudinal axis ($A_1$) and both port and starboard gunwales (21). A mounting bracket (20) is adapted to be supported from each gunwale (21), and a tilting frame (25) is supported from the mounting bracket (20) for pivotal movement about an axis ($A_2$) substantially parallel to the longitudinal axis ($A_1$) of the boat (11). A drive sub-assembly (31$_x$) is carried on the tilting frame (25) to be pivotal about a first angular rotational axis ($A_3$). A driven sub-assembly (31$_y$) is carried on the tilting frame (25) to be pivotal about a second angular rotational axis ($A_4$). A handle (14) is secured to the drive sub-assembly (31$_x$) for rotation about a first feathering axis ($A_5$). A blade (18) is secured to the driven sub-assembly (31$_y$) for rotation about a second feathering axis ($A_6$). A first drive (83 and 84) interconnects the drive and driven sub-assemblies (31$_x$ and 31$_y$) so that rotation of the drive sub-assembly (31$_x$) about the first angular rotational axis ($A_3$) effects rotation of the driven sub-assembly (31$_y$) about the second angular rotational axis ($A_4$). A second drive (78 and 79) interconnects the handle and blade (14 and 18) so that rotation of said handle (14) about the first feathering axis ($A_5$) effects concomitant rotation of the blade (18) about the second feathering axis ($A_6$).

14 Claims, 3 Drawing Sheets

FORWARD FACING ROWING MECHANISM

TECHNICAL FIELD

The present invention relates to a mechanism that may be employed in rowing a boat. More particularly, the present invention relates to a forward facing rowing mechanism—i.e., a mechanism which permits the oarsman to utilize the conventional power stroke whereby the oar handles are pulled toward the body in order to move the boat in that direction which the oarsman is facing rather than in a direction away from that which the oarsman is facing, as is the situation when one uses conventional oars. Specifically, the present invention relates to a mechanism interposed between the handle and the blade portions of each oar. The mechanism: (1) effects tilting of the blade portion in order to "catch" and to "finish" the power stroke by raising and lowering the handle portion, respectively, in the customary manner; (2) effects a reversal of the angular rotation of the blade portion in response to the customary movement of the handle portion; and, (3) effects feathering of the blade portion in response to the customary rotation of the handle portion.

BACKGROUND OF THE INVENTION

When a boat is rowed in the conventional manner, the oarsman sits facing the stern of the boat and manipulates the oars so that the power stroke is initiated when the blade portion enters the water toward the bow of the boat. The power stroke is then accomplished by having the oarsman pull the handle of the oars toward his body. This approach permits the oarsman to combine the strength of his legs, back and arms in pulling the handles and thereby driving the blade of each oar toward the stern. At the "finish" of the power stroke the oarsman manipulates the handles to raise the blades out of the water, after which the handles are moved away from the oarsman through what is known as the "recovery" phase of the stroke to position the blades for the "catch", or next beginning, of the power stroke.

If the oarlocks are "open", the oarsman may feather the oars so that the blades are disposed above, and parallel to, the surface of the water during the recovery phase of the stroke, and then unfeather the oars at the end of the recovery stroke, and immediately prior to the initiation of the power stroke. One wants the oars unfeathered for the power stroke in order to assure that the force applied to the handles is transmitted to the water by positioning the blades so that the maximum surface area of each blade will drive against the water during the power stroke. If, of course, the oarlocks are of the "pinned" variety, one cannot feather the oars.

The historic stroke sequence has been found to impart the maximum driving force to the water for the least effort by the oarsman. However, the major disadvantage is that the oarsman is facing away from the direction of movement. That fact has encouraged the development of a number of forward facing, or effort reversing, mechanisms to be employed when rowing a boat.

Typically, the prior known mechanisms are either of the boat-spanning variety—as shown in U.S. Pat. No. 3,857,356 issued Dec. 31, 1974—or of the gear-drive variety—as shown in U.S. Pat. No. 3,884,175 issued May 20, 1975, which uses spur type gears, and U.S. Pat. No. 4,623,314 issued Nov. 18, 1986, which uses rack and pinion type gears.

The boat-spanning type mechanisms require the oars to be considerably longer than conventional oars and thereby restricts the space available within the boat, at least when the boat is being rowed. These devices do not facilitate easy "shipping" of the oars, nor do they generally provide for feathering of the oars during operation.

Some of the gear-drive type rowing mechanisms do not permit feathering of the oars when in use, and the known gear-drive varieties that do permit feathering require a complicated supporting arrangement which adds to the weight and complexity of the system. It should also be appreciated that the gear-drive type rowing mechanisms are subject to reduced efficiency inasmuch as the environment within which such mechanisms are used fosters the introduction of dirt between, and/or the formation of corrosion on, the gear teeth. It has been suggested that this problem can be reduced by encasing the gear members, but the gear-drive mechanisms that are encased nevertheless appear to require continued, systematic maintenance which includes opening the casing, cleaning and greasing gears. Regardless of whether or not the gears are encased, any significant wear to the teeth cannot be tolerated. Worn teeth require that the gears be replaced. If the gears are not replaced, considerable backlash will be present during each direction reversal of the oars.

The rack and pinion type of gear drives have bearing members that contact an exposed surface on the rack. Excessive maintenance and too frequent replacement of the parts have proven to be required with these devices, particularly if any dirt or abrasive material adheres to the rack bearing surfaces. The rack and pinion devices can accommodate feathering of the oars, but the provision of that feature requires the addition of a complicated and bulky structure.

SUMMARY OF THE INVENTION

It is, therefore, a primary object of the present invention to provide an improved, forward facing, rowing mechanism.

It is another object of the present invention to provide a forward facing rowing mechanism, as above, which allows the handle of the oar operating in conjunction with said mechanism to be manipulated in a conventional manner in order to effect the "catch" and "finish" of the power stroke.

It is a further object of the present invention to provide a forward facing rowing mechanism, as above, which allows the handle of the oar to be manipulated in a conventional manner to effect feathering of the blade portion.

It is still another object of the present invention to provide a forward facing rowing mechanism, as above, which allows the handle of the oar to be manipulated in a conventional manner to effect the power stroke and yet the boat will be propelled in the direction that the oarsman is facing rather than away from the direction the oarsman is facing, as is the customary situation.

It is yet another object of the present invention to provide a forward facing rowing mechanism, as above, wherein the manipulation of the handle selectively to effect the tilting of the blade portion to "catch" the water at the initiation of the power stroke and to effect tilting of the blade portion to raise it out of the water at the "finish" of the power stroke does not impart any other motion to the blade portion.

It is a still further object of the present invention to provide a forward facing rowing mechanism, as above, wherein the manipulation of the handle selectively to effect the power stroke does not impart any other motion to the blade portion.

It is an even further object of the present invention to provide a forward facing rowing mechanism, as above, wherein the manipulation of the handle selectively to effect feathering of the blade portion does not impart any other motion to the blade portion.

It is also an object of the present invention to provide a forward facing rowing mechanism, as above, that is relatively compact so as not to encroach upon the interior of the boat.

It is an additional object of the present invention to provide a forward facing rowing mechanism, as above, which is relatively uncomplicated to manufacture and maintain.

It is a yet further object of the present invention to provide a forward facing rowing mechanism, as above, which can be economically manufactured, assembled and maintained.

These and other objects of the invention, as well as the advantages thereof over existing and prior art forms, which will be apparent in view of the following detailed specification, are accomplished by means hereinafter described and claimed.

In general, a forward facing rowing mechanism embodying the concepts of the present invention is particularly adapted for use with a boat having a bow and a longitudinal axis as well as a port and a starboard gunwale. At least one such rowing mechanism is mounted from, or with respect to each gunwale. Specifically, a mounting bracket is presented from each mechanism, and the mounting bracket is adapted to be supported from either gunwale. With continued reference, then, to an installation whereby the rowing mechanism is secured to either gunwale, a tilting frame is supported from the mounting bracket for pivotal movement about an axis that is substantially parallel to the longitudinal axis of the boat.

A drive sub-assembly is carried on the tilting frame to be pivotal about a first, angular rotational axis. A driven sub-assembly is carried on the tilting frame to be pivotal about a second, angular rotational axis. The first and second angular rotational axes are disposed in spaced relationship, one with respect to the other, and the two angular rotational axes are contained within a common plane disposed in substantially perpendicular relation to the axis about which the tilting frame is pivotally supported. A handle means is rotatably secured to the drive sub-assembly for rotation about a first feathering axis. A blade means is rotatably secured to the driven sub-assembly for rotation about a second feathering axis.

A first drive means in the nature of a force transmission member interconnects the drive and driven sub-assemblies so that fore and aft angular movement of the handle means rotates the drive sub-assembly about the first, angular rotational axis to effect rotation of the driven sub-assembly about the second, angular rotational axis to move the blade means angularly in the same fore and aft direction as the handle means—i.e.: a reversal in the direction of angular displacement between the handle portion and the blade portion is accomplished. A second drive means, also in the nature of a force transmission member, interconnects the handle and blade means so that rotation of the handle means about the first feathering axis effects concomitant rotation of the blade means about the second feathering axis.

The present invention is described in conjunction with one exemplary embodiment of a forward facing rowing mechanism which is deemed sufficient to effect a full disclosure of the subject invention. The exemplary forward facing rowing mechanism is described in detail without attempting to show all of the various forms and modifications in which the invention might be embodied; the invention being measured by the appended claims and not by the details of the specification.

DESCRIPTION OF AN EXEMPLARY EMBODIMENT

Figure 5:
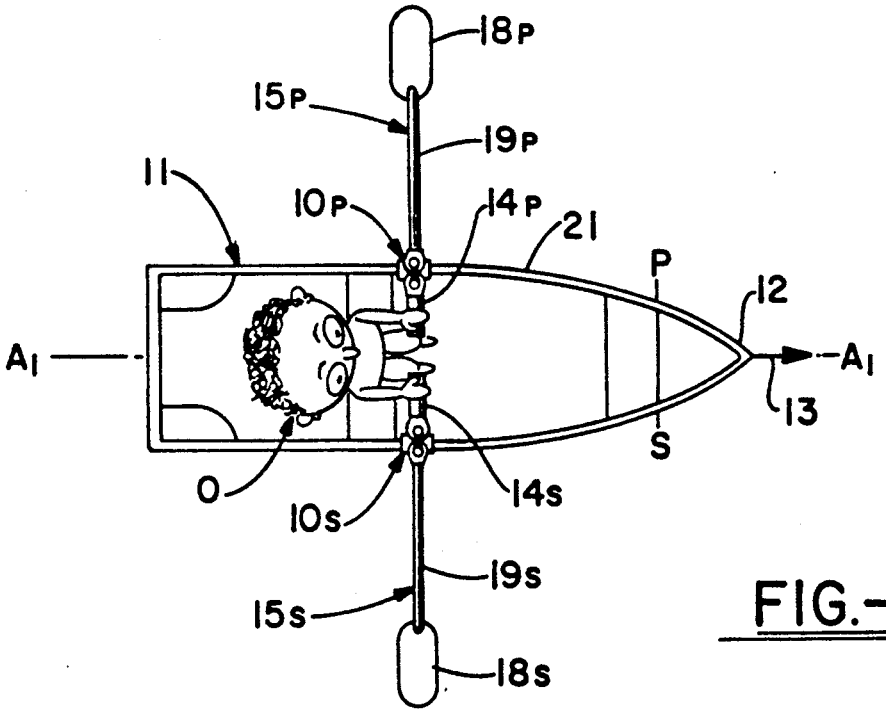
FIG. 5 is a schematic, top plan view of a row boat on which a port and starboard forward facing rowing mechanism embodying the concepts of the present invention are mounted, said figure depicting an oarsman seated facing the direction of travel, with the oars amidships in the feathered position.

One representative form of a forward facing rowing mechanism is depicted on the drawings attached hereto, and is identified generally by the numeral 10. With reference to the drawings, wherein like characters represent the same or corresponding parts throughout the several views, FIG. 5 schematically depicts an oarsman "O" seated in line with the longitudinal axis $A_1$ of a row boat 11, and facing the bow 12 thereof, which is aimed in the direction of intended travel, as represented by the arrow 13. The oarsman "O" has his hands on the gripping, or handle, portions $\mathbf{14}_P$ and $\mathbf{14}_S$ of a pair of oars $\mathbf{15}_P$ and $\mathbf{15}_S$, respectively.

In order to distinguish between the components on one side of the boat from those on the other side, the designation "P" shall be employed to designate the port side of the row boat 11, and the designation "S" shall be employed to designate the starboard side of the boat 11. In fact, the port and starboard sides of the boat 11 are designated by the letters "P" and "S" in FIG. 5. In the text of this specification, when it is desire to locate a component otherwise designated by a numerical identifier as being on either the port or starboard side of the boat, the "P" or "S" designations shall be employed in conjunction with the numeric identifier as a subscripted suffix.

Each oar 15 also has a blade portion 18 and the blade portions 18 of each oar 15 are separated from the handle portions 14 by a shaft, or barrel, portion 19. The respective handle portions $\mathbf{14}_P$ and $\mathbf{14}_S$ of the port and starboard oars are connected to a blade portion $\mathbf{18}_P$ and $\mathbf{18}_S$, respectively, through a pair of forward facing rowing mechanisms $\mathbf{10}_P$ and $\mathbf{10}_S$, respectively.

Inasmuch as the port and starboard oars 15 are mirror images of each other, and inasmuch as both employ an identical forward facing rowing mechanism 10, only one of those rowing mechanisms will be described. The forward facing rowing mechanism 10 which is employed on the port side of the boat has been arbitrarily chosen as the one to be described.

As depicted in the appended drawings, the forward facing rowing mechanism 10 has a mounting bracket 20 (FIGS. 1, 2 and 4) which may be secured, either removably or permanently, to, or from, the gunwale 21 of the row boat 11 by any conventional attaching structure. That is, the mounting bracket 20 may be supported directly on either gunwale, or the mounting bracket 20 may be supported from either gunwale to be disposed outboard thereof, as would be desired when using the mechanism 10 on a narrow boat such as a sculling shell. It would also be advantageous to support the rowing mechanism outboard of the gunwale in the situation where one would prefer to employ a longer handle portion 14 in order to increase the length of the lever arm and thereby increased the mechanical advantage by which the blade portion 18 is swept through the water during the power stroke. Irrespective of whether the rowing mechanism 10 is supported on, or from, the gunwale, the mounting bracket 20 may utilize a pair of upstanding gudgeons 22A and 22B which support a trunnion pin 23 that is secured to, and extends between, the gudgeons 22A and 22B. It is important that the axis $A_2$ of the trunnion pin 23 be disposed in substantially parallel relation to the longitudinal axis $A_1$ of the row boat 11, for reasons that will hereinafter become apparent.

As may be apparent from the identification used on conjunction with the gudgeons identified in the previous paragraph, and as will appear in the detailed description which follows, a particular structural member, component or arrangement may be employed at more than one location. When referring generally to that type of structural member, component or arrangement a common numerical designation shall be employed. However, when one of the structural members, components or arrangements so designated is to be individually identified it shall be referenced by virtue of a letter suffix employed in combination with the numerical designation employed for general identification of that structural member, component or arrangement. Thus, there are at least two gudgeons heretofore described which are generally identified by the numeral 22, but the specific, individual gudgeons are, therefore, identified as 22A and 22B, respectively, in the specification and on the drawings. This same suffix convention shall be employed throughout the specification. Accordingly, when the gudgeons 22 are described, it should be understood that the individual gudgeons 22A and 22B are identical so that the description of one would apply equally to the other. It should also be noted that the various axes identified in the description of the exmplary embodiment are generally designated with the letter "A", with each specific axis identified by a subscripted numeral.

A tilting frame 25 is pivotally supported from the mounting bracket 20 by the trunnion pin 23 which is rotatably received through a skirt portion 24 that extends downwardly from the base plate 26 of the tilting frame 25. A pair of bushings 28A and 28B are preferably interposed between the trunnion pin 23 and the skirt portion 24 to facilitate pivotal movement of the tilting frame 25 relative to the mounting bracket 20, and about axis $A_2$.

Figures 3, 6, 7, 8, 9, 10:
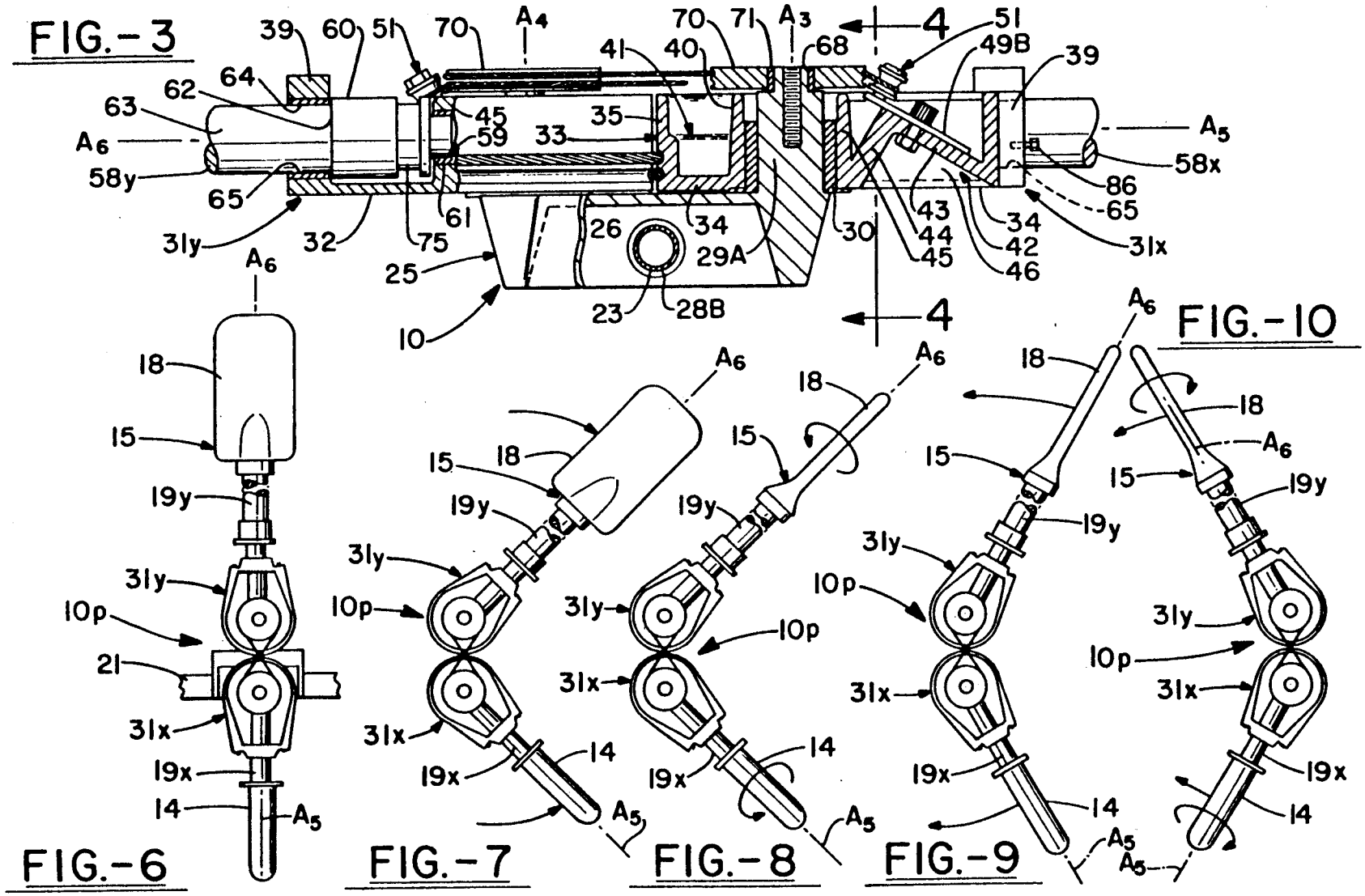
FIG. 3 is a side view similar to FIG. 2 but with portions broken away more clearly to reveal the various structural elements employed in the mechanism.
FIG. 6 is a schematic top plan of the forward facing rowing mechanism supported from the port gunwale and with the components disposed in the same disposition as represented in FIG. 5.
FIG. 7 is a schematic top plan similar to FIG. 6 but which depicts the sequential disposition of the blade portion after the handle portion has been swung from the amidships position represented by FIG. 6 to the position at which the power stroke is initiated.
FIG. 8 is a schematic top plan similar to FIGS. 6 and 7 which depicts the rotated disposition of the paddle portion from the feathered position of FIG. 7 to the unfeathered, or working, position.
FIG. 9 is a schematic top plan similar to FIGS. 6 through 8 which depicts the disposition of the handle and blade portions at the initiation of the power stroke.
FIG. 10 is a schematic top plan similar to FIGS. 6 through 9 which depicts the completion of the power stroke just prior to the blade portion being feathered.

As best seen from FIG. 3, a pair of mounting posts 29 extend upward from the base plate 26 of the tilting frame 25 to define two laterally spaced, rotational axes $A_3$ and $A_4$. Although only mounting post 29A is depicted, an identical mounting post (not shown) is spaced laterally to the left thereof (as viewed in FIG. 3), the location of which is identified by axis $A_4$. The axis $A_3$ is the angular, rotational axis of the components rotatably mounted on or about mounting post 29A, and the axis $A_4$ is the angular, rotational axis of the components rotatably mounted on or about the other mounting post (not shown). The axes $A_3$ and $A_4$ are preferably contained within a common plane disposed perpendicularly with respect to the pivotal axis $A_2$ of the trunnion pin 23. Moreover, the axes $A_3$ and $A_4$ are also preferably centered, one on either side of the pivotal axis $A_2$ about which the tilting frame 25 pivots with respect to the mounting bracket 20 so that axis $A_3$ is disposed inboard of the axis $A_4$. Conversely, axis $A_4$ is disposed outboard of the axis $A_3$. A bushing 30, or other bearing means, may be disposed on each mounting post 29 rotatably to support individual sub-assemblies 31. Specifically, a drive sub-assembly $\mathbf{31}_X$ is mounted on that post 29 which defines the angular rotational axis $A_3$. A driven sub-assembly $\mathbf{31}_Y$ is mounted on that post (not shown) which defines the angular rotational axis $A_4$.

The shaft, or barrel, 19 of a standard oar 15 may be severed such that a portion $\mathbf{19}_X$ (FIGS. 6–10) thereof is conjoined to the handle portion 14 of the oar 15, and portion $\mathbf{19}_Y$ thereof is conjoined to the blade portion 18 of the oar 15. The portion $\mathbf{19}_X$ of the barrel 19 is operatively secured to the drive sub-assembly $\mathbf{31}_X$, and the portion $\mathbf{19}_Y$ of the barrel 19 is operatively secured to the driven sub-assembly $\mathbf{31}_Y$.

The body portion 32 of each sub-assembly $\mathbf{31}_X$ and $\mathbf{31}_Y$ includes an outer wall 33 (FIGS. 1 and 3) which extends upwardly from a base wall 34 of the sub-assembly 31. The outer wall 33 describes a substantially horseshoe-shaped configuration, as viewed in FIG. 1, such that a curvilinear surface shall extend along at least a portion thereof. As such, the outer wall 33 may have a semi-cylindrical portion 35, the opposite ends of which tangentially merge with moderately converging planar, portions 36 and 38, respectively. The converging planar portions 36 and 38, in turn, terminate at a transversely disposed end wall 39. The converging planar portions 36 and 38 of the outer wall 33 extend inboard to the end wall 39 on the drive sub-assembly $\mathbf{31}_X$, but the converging portions 36 and 38 of the outer wall 33 extend outboard to the end wall 39 on the driven sub-assembly $31_Y$.

With reference to FIG. 3, it may be observed that each sub-assembly 31 has an annular support tower 40 which also extends upwardly from the base 34, and which is located concentrically inwardly of the semi-cylindrical portion 35 of the outer wall 33. An open area 41 is thus provided between the support tower 40 and the outer wall 33. A support wall 42 extends interiorly of the open area 41 from each converging planar portion 36 and 38. Each support wall 42 is conjoined to the base wall 34 at, or in proximity to, the end wall 39, and a portion 43 of each support wall 42 is inclined upwardly, and away, from the end wall 39 to join with a portion 44 of the support wall 42 which is inclined downwardly and still away from the end wall 39, to rejoin the base wall 34 and merge with a portion of the support tower 40. A bearing wall 45, which is disposed tangentially along that side of the support tower 40 which faces the end wall 39, extends upwardly from the base wall 34 at, or in proximity to, the merger of the portion 44 with the base wall 34.

A closure wall 46 extends upwardly from the base wall 34 and perpendicularly intercepts the portions 43 and 44 of the support wall 42. The closure walls 46A and 46B associated with the respective support walls 42A and 42B are disposed in opposed, and substantially parallel, relation and are laterally spaced to define a channel passage 48 therebetween which provides unobstructed access between the end wall 39 and the bearing wall 45 in each sub-assembly 31, for a purpose more fully hereinafter explained.

A pair of capstan support bars 49A and 49B (FIG. 1) are independently mounted on the respective portions 43A and 43B of the support walls 42A and 42B, as by fastening means in the nature of screws 50A and 50B which will permit each support bar 42 to swing about its fastening screw 50 to at least a limited degree. By locating the fastening screw 50 within the medial portion of each capstan support bar 49, the support bars 49 become first class levers. A turning means in the nature of a capstan 51 is located in proximity to one end of each support bar 49, and an adjusting means 52 engages the opposite end portion 53 of each support bar 49 to swing the support bar 49 and thereby select the precise location desired for the capstan 51, as will be hereinafter more fully explained. One form of an acceptable adjusting means 52 comprises a set screw 54 that is received within a threaded bore 55 that penetrates each planar portion 36 and 38 of the outer wall 33. By turning selected set screws 54, the support bars 49 are selectively pivoted to locate the position of the capstan 51 along the arc through which it moves as the support bar 49 is swung.

The bushing 30 interposed between the mounting post 29 and the support tower 40 thus permits each sub-assembly 31 to rotate on the tilting frame 25. That is, the drive sub-assembly $31_X$ rotates about the angular rotational axis $A_3$, and the driven sub-assembly $31_Y$ rotates about the angular rotational axis $A_4$.

A stepped connecting stub shaft 58 is rotatably mounted in each sub-assembly 31. A journal 59 extends axially outwardly from that portion 60 of the connecting stub shaft 58 having the largest outside diameter, and the journal 59 is rotatably mounted in a bearing 61 presented from the bearing wall 45. The shoulder 62 formed at the juncture of the portion 60 having the largest outside diameter with the portion 63 having the smaller outside diameter may serve as a thrust contact with the end wall 39 and the portion 63 having the smaller outside diameter is journaled within a bushing 64 in the bore 65 through the end wall 39. As should now be apparent, the unobstructed channel passage 48 between the laterally opposed closure walls 46 thus accommodates the connecting stub shaft 58. The connecting stub shaft $58_X$ mounted in the drive sub-assembly $31_X$ is rotatable about its own axis, the handle feathering axis $A_5$, and the connecting stub shaft $58_Y$ mounted in the driven sub-assembly $31_Y$ is rotatable about its own axis, the blade feathering axis $A_6$.

A coupling member 66 (FIG. 1) is secured to each connecting stub shaft 58 to receive the appropriate barrel portion $19_X$ or $19_Y$ of each oar 15 so that the connecting stub shaft 58 and barrel portion 19 secured by each coupling member 66 will always rotate together about their own axis $A_5$ or $A_6$. As can be observed from FIG. 1 and 6, the feathering axes $A_5$ and $A_6$ are aligned when the handle portion 14 of the oar 15 is positioned amidships.

With reference again to FIG. 3, a mounting extension 68 extends upwardly from each mounting post 29. The outside diameter of the mounting extension 68 is less than the outside diameter of the mounting post, and a sheave 70 is rotatably mounted thereon. To facilitate rotation of the sheave 70 a sleeve bushing 71 may be interposed between the mounting extension 68 and the sheave 70. The cylindrical perimeter wall 72 (FIG. 4) of the sheave 70 is provided with guide means in the nature of two, unconnected, and axially displaced, semi-annular grooves 73 and 74 that circumscribe the sheave 70.

An annular recess 75 (FIGS. 1, 3 and 4) preferably circumscribes that portion 60 of the stepped connecting stub shaft 58 having the largest outside diameter, and a passage 76 (FIG. 4) extends diametrically through the shaft 58 within the recess 75. A pair of flexible force transmitting members in the nature of drive wires, or cables, 78 and 79 extend into the diametric passage 76 from one side thereof, and the cables 78 and 79 are secured therein by a locking means 80 in the nature of a set screw 81 received within a threaded bore 82 that extends inwardly from the recess 75 to intersect the diametric passage 76 at substantially a right angle. As the drive wires 78 and 79 exit the diametric passage 76 within which they are anchored, one drive wire 78 is wrapped in one direction about the annular recess 75, and the other drive wire 79 is wrapped in the opposite direction about recess 75. Each drive wire 78 and 79 is initially wrapped approximately one half a revolution about the annular recess 75.

Figure 4:
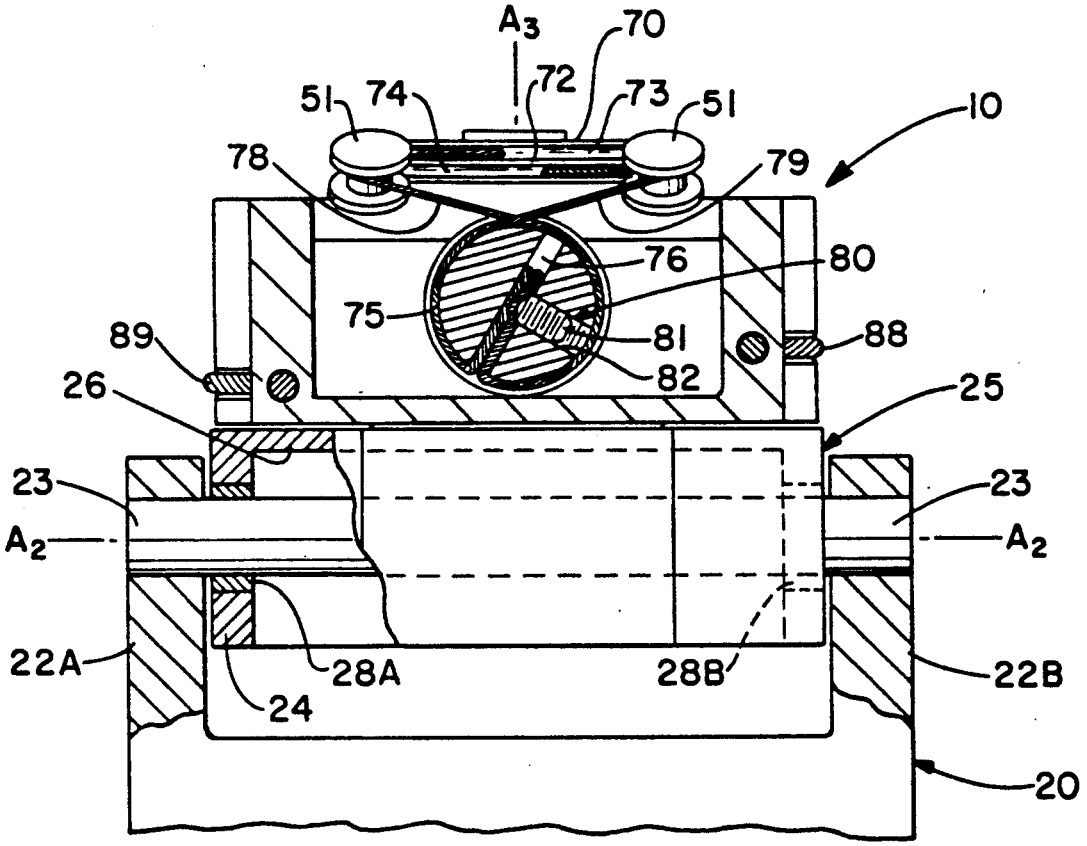
FIG. 4 is an enlarged cross-sectional view as may be taken along line 4—4 of FIG. 3.

With continued reference to FIG. 4, the drive wire 78 is reeved counterclockwise about the annular recess 75 and then clockwise about the capstan 51 (FIG. 1) presented from the capstan support bar 49A and thence counterclockwise within the semi-annular groove 74 in the sheave 70 mounted in the drive sub-assembly $31_X$ to cross into the corresponding semi-annular groove 74 in the sheave 70 mounted in the driven sub-assembly $31_Y$ and extend clockwise thereabout for slightly less than one half the circumference thereof before being reeved about capstan 51 mounted on the capstan support bar 49A in the driven sub-assembly $31_Y$. The drive wire 78 leaves the capstan 51 to be wound approximately one half a revolution about the annular recess 75 in the stub shaft 58 carried on the driven sub-assembly $31_Y$ and is anchored to that stub shaft 58 in preferably the same manner as heretofore described in conjunction with the anchoring of the drive wires 78 and 79 to the stub shaft 58 carried by the drive sub-assembly $31_X$.

Conversely, the drive wire 79 is reeved clockwise (as viewed from FIG. 4) about the annular recess 75, and from the annular recess 75 counterclockwise about the capstan 51 (FIG. 1) presented from the capstan support bar 49B and thence clockwise within the semi-annular groove 73 in the sheave 70 mounted in the drive sub-assembly $31_X$ to cross into the corresponding semi-annular groove 73 in the sheave 70 mounted in the driven sub-assembly $31_Y$ and extend counterclockwise thereabout for slightly less than one half the circumference thereof before being reeved clockwise about capstan 51 mounted on the capstan support bar 49B in the driven sub-assembly $31_Y$. The drive wire 79 leaves the capstan assembly to be wound approximately one half a revolution about the annular recess 75 in the stub shaft 58 carried on the driven sub-assembly $31_Y$ and is anchored to that stub shaft 58 in preferably the same manner as heretofore described in conjunction with the anchoring of the drive wires 78 and 79 to the stub shaft 58 carried by the drive sub-assembly $31_X$.

For purposes of explanation it will be assumed that FIG. 4 depicts the position of the stub shaft 58 in the drive sub-assembly $31_X$ when the oar $15_p$ is amidships with the blade portion $18_p$ feathered, as depicted in FIG. 6. It will also be assumed that for the port oar $15_p$ it will be desired that the handle portion $14_p$ should be rotated clockwise to feather the blade portion $18_p$ and counterclockwise to unfeather the blade portion $18_p$ and thereby dispose it in the working position. Under that assumption it will be desirable to have the diametric passage 76 slightly canted when the blade portion 18 is either fully feathered (as depicted in FIGS. 5, 6, and 7) or fully unfeathered (as depicted in FIGS. 8 and 9) to assure that enough drive wire will be available to effect a 90 degree rotation of the handle portion $14_p$.

As such, to explain how the blade portion $18_p$ is unfeathered one can begin by reference to FIG. 4 and imagine that the handle portion $14_p$ attached to the stub shaft $58_X$ is rotated counterclockwise—i.e., about the handle feathering axis $A_5$ in the direction of the arrow depicted in FIG. 8. Such rotation applies a tensile stress to the drive wire 79 and conversely tends to remove any loading on the drive wire 78. As the drive wire 79 is thus wrapped onto the annular recess 75 the movement thereof under a tensile loading causes the sheave 70 in sub-assembly $31_X$ to rotate counterclockwise, as viewed in FIG. 1, and sheave 70 in sub-assembly $31_Y$ to rotate in a clockwise direction. As the drive wire 79 passes about the capstan 51 on capstan support bar 49B and onto the annular recess 75 in the driven sub-assembly $31_Y$ it causes the connecting stub shaft 58 to rotate about the blade feathering axis $A_6$ in the direction of the arrow appearing in FIG. 8, thus rotating the blade portion $18_p$ from the feathered to the unfeathered position. It should be appreciated that even though the a drive wire can only transmit forces in tension, the drive wire 78 will, by the imparted rotation to the blade portion $18_p$, be wrapped onto the connecting stub shaft 58 in the driven sub-assembly $31_Y$ so that it will be available to transmit the forces necessary to effect a feathering of the blade portion $18_p$ when required.

Conversely, then, clockwise rotation of the handle portion $14_p$—i.e.: about the handle feathering axis $A_5$ in the direction of the arrow depicted in FIG. 10—will effect a feathering of the blade portion $18_p$. However, when the handle portion $14_p$ is rotated clockwise tensile stress is applied to the drive wire 78 which is thereby pulled about the capstan 51 on the capstan support bar 49A in the drive sub-assembly $31_X$ to effect clockwise rotation of the sheave 70 (FIG. 1), also in the drive sub-assembly $31_X$, which, in turn, effects counterclockwise rotation of the sheave 70 in the driven sub-assembly $31_Y$ and thereby rotation of the connecting stub shaft 58 about the blade feathering axis $A_6$ in the direction of the arrow depicted in FIG. 10, thus rotating the blade portion $18_p$ from the unfeathered, or working, position to the feathered position. Here too, the drive wire 79 will, by the imparted rotation to the blade portion $18_p$, be wrapped onto the connecting stub shaft 58 in the driven sub-assembly $31_Y$ so that it will be available to transmit the forces necessary to effect a unfeathering of the blade portion $18_p$ when required. It should be appreciated that the paddle portions 18 can be caused to rotate through greater or lesser angles than the angle through which the handle portion 14 is rotated by controlling the ratio of the diameters, at the wrap point of the drive wires onto the annular recess 75, to a value other than one to one (1.0:1.0). However, for simplicity of manufacture and assembly, the preferred ratio is one to one.

Figures 1, 2:
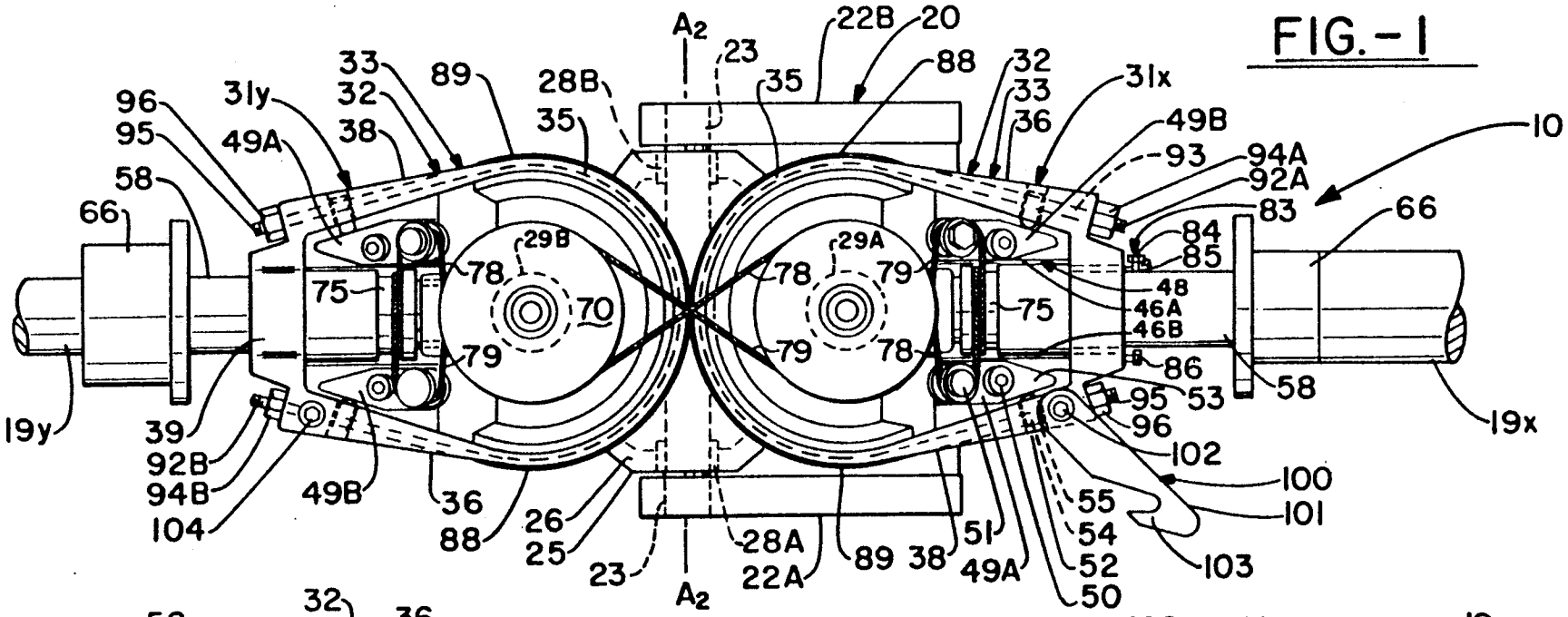
FIG. 1 is a top plan view of a forward facing rowing mechanism which embodies the concepts of the present invention and which permits the oarsman to be seated facing the direction in which the boat is traveling.
FIG. 2 is a side elevational view of the mechanism depicted in FIG. 1.

Some oarsmen may prefer to refer visually to the blade portion 18 and then rotate the handle portion 14 appropriately to effect feathering, or unfeathering. However, it is deemed preferable to provide a blocking means 83 which will afford a tactile indication as to when the blade portion 18 either fully feathered or fully unfeathered. Such blocking means 83 can also serve to preclude one from attempting to over-rotate the handle portion 14 and thereby apply excessive forces on the drive wires 78 or 79 which would tend to overload the locking means 80. As best seen in FIGS. 1–3, an acceptable form of blocking means 83 may utilize a radially extending contact arm 84 on the stub shaft 58 which engages pin delineator 85—that extends axially outwardly from the end wall 39—when the blade portion 18 is fully feathered, or the pin delineator 86—that also extends axially outwardly from the end wall 39—when the blade portion 18 is fully unfeathered. The contact arm 84 and the pin delineators 85 and 86 may well be cap screws, as shown.

It is important to appreciate that rotation of the handle portion 14 and the blade portion 18 about their respective feathering axes $A_5$ and $A_6$ will not affect the relative positioning of the sub-assemblies $31_X$ and $31_Y$ on their respective axes of angular rotation $A_3$ and $A_4$. Conversely, rotation of the sub-assemblies $31_X$ and $31_Y$ about their respective axes of angular rotation $A_3$ and $A_4$ will not affect the feathered, or unfeathered, disposition of the blade 18.

The aforesaid angular rotation of the sub-assemblies $31_X$ and $31_Y$ is controlled by a pair of flexible drive cables 88 and 89 which cooperate with the opposed, curvilinear portions of the drive and driven sub-assemblies $31_X$ and $31_Y$. Specifically, the semi-cylindrical portion 35 of the outer wall 33 is provided with guide means that may comprise semi-annular guide grooves 90 and 91. The cable 88 is received in the substantially semi-annular guide groove 90 in sub-assembly $31_X$, and the opposing, semi-annular groove 90 in sub-assembly $31_Y$. The end portions of the cable 88 are secured to threaded end rods 92A and 92B. End rod 92A extends within an anchor bore 93 formed in the planar wall 36 of sub-assembly $31_X$ and outwardly through the end wall 39 to receive an adjusting nut 94A. Similarly, end rod 92B extends within an anchor bore 93 formed in the planar wall 36 of sub-assembly $31_Y$ and outwardly through the end wall 39 to receive an adjusting nut 92B.

The cable 89 is received in the substantially semi-annular guide groove 91 in the outer wall 33 on sub-assembly $31_X$, and the opposing, semi-annular groove 91 in sub-assembly $31_Y$. The end portions of the cable 89 are secured to threaded end rods 95A and 95B. End rod 95A extends within an anchor bore 96 formed in the planar wall 38 of sub-assembly $31_X$ and outwardly through the end wall 39 to receive an adjusting nut 98A. Similarly, end rod 95B extends within an anchor bore 96 formed in the planar wall 38 of sub-assembly $31_Y$ and outwardly through the end wall 39 to receive an adjusting nut 92B.

As can be seen from the drawings, the semi-annular grooves 90 and 91 do not interconnect, but are instead parallel and displaced, one from the other. The semi-annular grooves 90 and 91 in the sub-assembly $31_X$ are, however, aligned with the respective semi-annular grooves 90 and 91 in the sub-assembly $31_Y$. As such, the drive cables 88 and 89 each lie in their own plane as they cross-connect between the sub-assemblies $31_X$ and $31_Y$.

Operation

To describe the operation of the forward facing rowing mechanism 10, we can begin with the oars in the amidships position, as represented by FIG. 5, but to simplify this description reference will only be made to the operation of the rowing mechanism 10, and the oar 15, on the port side "P" of the boat 11. Accordingly, the description will begin with specific reference to FIG. 6 which depicts the oar $15_p$ in the amidships position. The paddle portion $18_p$ is feathered—i.e.: the blade portion $18_p$ is disposed with its broadest dimension extending fore and aft, and lying parallel to the water—and it will be presumed that the oarsman "O" has his hands on the handle portion $14_p$, as is represented in FIG. 5.

In order to propel the boat 11 the oarsman "O" will first maneuver the oars 15 from the position shown in FIG. 6 to the position shown in FIG. 7. That result is accomplished by pushing the handle portion $14_p$ away from the oarsman's body and toward the bow 12 of the boat 11 in order to rotate the sub-assembly $31_X$ counterclockwise about axis $A_3$. When the handle $14_p$ is thus pushed away from the oarsman, the resulting counterclockwise rotation of the sub-assembly $31_X$ imparts a tensile load to the cable 89, and cable 88 is not directly loaded by sub-assembly $31_X$. The tensile loading applied to cable 89 causes the sub-assembly $31_Y$ to rotate clockwise about axis $A_4$ in response to the counterclockwise rotation of sub-assembly $31_X$. Although it was stated that cable 88 is not directly loaded by rotation of the sub-assembly $31_X$, a tensile load is, however, indirectly applied to the cable 88 as a result of the rotation imparted to sub-assembly $31_Y$ by cable 89. When the handle and blade portions $14_p$ and $18_p$, respectively, are in the position depicted in FIG. 7 the "recovery" portion of the rowing cycle has been completed, and the oarsman "O" prepares for the "catch".

As the paddle portion $18_p$ arrives at the position depicted in FIG. 7 it is feathered. To unfeather the blade portion $18_p$ the handle portion $14_p$ is rotated about axis $A_5$ in the direction of the arrow in FIG. 8. Such rotation of handle portion $18_p$ applies a tensile loading to the drive wire 79 which rotates the sheave 70 in sub-assembly $31_X$ counterclockwise and the sheave 70 in sub-assembly $31_Y$ clockwise to effect rotation of the blade portion $18_p$ about axis $A_6$ in the direction of the arrow in FIG. 8 to arrive at the disposition of the blade portion 18 that is depicted in FIG. 8. So configured, the blade portion $18_p$ is ready for the "catch"—i.e.: the blade is ready to enter the water at the beginning of the power stroke.

To lower the blade portion $18_p$ the oarsman "O" raises the handle portion $14_p$ to pivot the tilting frame about the axis $A_2$ of the trunnion pin 23, thus lowering the blade portion $18_p$ into the water. Simultaneously therewith the oarsman "O" pulls the handle portion $18_p$ sternward, toward himself, in the customary manner of a power stroke but rather than move forwardly, the blade portion $18_p$ also moves rearwardly. This movement is effected as a result of the application of a tensile loading to the drive cable 88 which rotates the sub-assembly $31_Y$ counterclockwise about axis $A_4$. Movement of the paddle portion $18_p$ from the position depicted in FIG. 9 to that depicted in FIG. 10 constitutes the power stroke which drives the row boat 11 forwardly in the direction which the oarsman "O" is facing.

At the conclusion of the power stroke the oarsman "O" lowers the handle portion $18_p$ to pivot the tilting frame 25 about axis $A_2$ of the trunnion pin 23 and thereby raise the paddle portion $18_p$ out of the water in what is termed the "finish" portion of the stroke. The oarsman thereupon rotates the handle portion $18_p$ about axis $A_5$ in the direction of the arrow in FIG. 10 to apply tensile loading to the drive wire 79 which rotates the sheave 70 in the sub-assembly $31_X$ clockwise about axis $A_3$ and the sheave 70 in sub-assembly $31_Y$ counterclockwise to effect clockwise rotation of the blade portion $18_p$ about axis $A_6$ (also in the direction of the appropriate arrow in FIG. 10) in order to feather the blade portion $18_p$. At that point the handle portion $14_p$ may be moved toward the bow 12 of the boat 11 to accomplish the sequential recovery portion of the stroke.

The drive cables 88 and 89 must be able to withstand the tensile stresses induced by at least the power portion of the stroke. The cable 88 is stressed when the mechanism 10 is mounted to port, and cable 89 is stressed when the mechanism 10 is mounted to starboard. The size of the drive cables 88 and 89 are is chosen accordingly. In the event that the cables 88 and 89 stretch slightly as a result of repetitive application of relative large tensile stresses, they can be easily retightened by the adjusting nuts 94 and 98. This operation should not require any special tooling inasmuch as a conventional wrench, or socket, will suffice. Moreover, the tightening operation can be performed without removing either the handle or the paddle portions 14 or 18, respectively, of any oar 15 from the rowing mechanism 10. In fact, the operation can be performed while the oars are in the shipped position if desired.

During feathering, and unfeathering, one or the other of the drive wires 78 and 79 will decrease the extent to which it is wrapped about the annular recess 57 on the stepped, connecting stub shaft 58 and the other drive wire will increase the extent to which it is wrapped about the annular recess 75. Because the capstans 51 and the sheaves 70 are freely rotatable, minimum or no wearing action will occur at these surfaces. Moreover, the forces required to feather, and unfeather, the oars 15 is very light. For that reason, as well, there is virtually no stretching of the drive wires 78 and 79. However, the tension of the drive wires 78 and 79 can be easily adjusted by loosening of the fastening means 50 which secures the appropriate capstan support bar 49 and then turning the set screw 54 until the capstan support bar 49 has been rotated sufficiently to tighten the drive wire reeved about the capstan 51 carried thereon. Thereafter the fastening means 50 can be retightened to lock the capstan support bar 49 in the disposition which provides the desired tension to the drive wires 78 and/or 79.

It should be appreciated that the rowing mechanism 10, as well as the oars 15 associated therewith, are identical irrespective of whether they are to be employed on the port or starboard side of the boat 11. Accordingly, all the various components can be stored in inventory for interchangeable usage, and the inventory and manufacturing costs are thereby held to a minimum. In addition, the handle portions 14 and the paddle portion 18 can be installed either before or after the various drive wires 78 and 79 and drive cables 88 and 89 are installed, which facilitates packaging and shipping of the forward facing rowing mechanism 10.

As best seen in FIGS. 1 and 2, a latching mechanism 100 can easily be incorporated into the oar structure. One end of a latch bar 101 may be pivotally mounted on either sub-assembly $31_X$ or $31_Y$, as by a mounting bolt 102. The opposite end of the latch bar 101 presents a hook 103 that is engageable with a latching post 104 presented from the other sub-assembly $31_Y$ or $31_X$. As shown, the latch bar 101 is mounted on the planar wall 38 of sub-assembly $31_X$ to selectively connect with the latching post 104 presented from planar wall 36 on sub-assembly $31_Y$. As such, the hook 103 will engage latching post 104 when the handle portion 14 has been manipulated to the rearmost position. In this position, the planar wall 38 on sub-assembly $31_X$ will lie adjacent to the planar wall 36 on sub-assembly $31_Y$, and the blade portion 18 is then also disposed in its rearmost position to lie substantially parallel to the handle portion 14. This is the "shipped" position of the oar 15. In this position the latching mechanism 100 can be secured to prevent movement of the parts, as might be desired when the boat is tied to its mooring or brought dockside.

Finally, it should be observed that each mounting extension 68 may be provided with an axially oriented, threaded bore 105. A bolt (not shown) may be secured within the threaded bore 105 to mount a cover (also not shown), or the bore 105 may receive a fastening means to assure that the sheaves 70 remain rotatably positioned on their respective mounting extensions 68.

The foregoing description of an exemplary embodiment of a forward facing rowing mechanism has been presented for the purposes of illustration and description. It is not intended to be exhaustive nor is it intended to limit the invention to the precise form disclosed. Obvious modifications, or variations, are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

As should now be apparent, the present invention not only discloses and teaches an improved forward facing rowing mechanism but also makes it apparent that the other objects of the invention can be accomplished.

I claim:

1. A forward facing rowing mechanism for a boat having a bow, a longitudinal axis and both port and starboard gunwales, said rowing mechanism comprising:

a mounting bracket adapted to be supported from each gunwale;

a tilting frame supported from said mounting bracket for pivotal movement about an axis substantially parallel to the longitudinal axis of the boat;

a drive sub-assembly carried on said tilting frame to be pivotal about a first, angular rotational axis;

a driven sub-assembly carried on said tilting frame to be pivotal about a second, angular rotational axis;

said first and second angular rotational axes being disposed in spaced relationship relative to each other and being contained within a common plane disposed in substantially perpendicular relation to the axis about which said tilting frame is pivotally supported;

handle means;

a first feathering axis disposed longitudinally of said handle means;

said handle means being secured to said drive sub-assembly for rotation about said first feathering axis;

blade means;

a second feathering axis disposed longitudinally of said blade means;

said blade means being secured to said driven sub-assembly for rotation about said second feathering axis;

first drive means interconnecting said drive and driven sub-assemblies so that fore and aft angular movement of said handle means to rotate said drive sub-assembly about said first, angular rotational axis effects rotation of said driven sub-assembly about said second, angular rotational axis to move said blade means angularly in the same for and aft direction as said handle means;

and, second drive means for interconnecting said handle and blade means so that rotation of said handle means about said first feathering axis effects concomitant rotation of said blade means about said second feathering axis said second drive means comprising first flexible force-transmitting means operatively connected between said handle means and said blade means for effecting said concomitant rotation in one direction and second flexible force-transmitting means operatively connected between said handle means and said blade means for effecting said concomitant rotation in another direction.

2. A forward facing rowing mechanism, as set forth in claim 1, wherein:

each said drive and driven sub-assemblies has an outer wall with a curvilinear surface along at least a portion thereof;

said curvilinear surface on said drive sub-assembly being disposed in opposition to said curvilinear surface on said driven sub-assembly when said sub-assemblies are disposed on said tilting frame;

said first drive means employing at least two lengths of a flexible force-transmitting member with opposite ends;

one end of each force-transmitting member being secured to said outer wall of said drive sub-assembly, and the second end of each said force-transmitting member being secured to the outer wall of said driven sub-assembly;

said force-transmitting members being disposed in a crisscross pattern between said drive and driven sub-assemblies whereby rotation of said drive sub-assembly about said first, angular rotational axis effects rotation of said driven sub-assembly about said second, angular rotational axis.

3. A forward facing rowing mechanism, as set forth in claim 2, further comprising:

at least two guide means associated with the outer wall of each said drive and said driven sub-assemblies to direct said force-transmitting members;

said guide means associated with said drive sub-assembly being aligned with corresponding guide means associated with said driven sub-assembly.

4. A forward facing rowing mechanism, as set forth in claim 3, wherein:

said guide means utilizes grooves recessed in the outer walls of said drive and driven sub-assemblies.

5. A forward facing rowing mechanism, as set forth in claim 2, further comprising:

a pair of sheaves mounted from said tilting frame;

one said sheave mounted for rotation about said first angular rotational axis and the second sheave mounted for rotation about said second angular rotational axis;

turning means mounted on said drive and driven sub-assemblies;

said first and second flexible force transmitting means of said second drive means being reeved about respective ones of said sheaves and turning means such that rotation of said handle means effects concomitant rotation of said blade means, irrespective of the angular disposition of said handle means relative to said blade means.

6. A forward facing rowing mechanism, as set forth in claim 5, further comprising:

a cylindrical perimeter wall circumscribing each said sheave;

guide means extending circumferentially of said cylindrical perimeter wall to direct said force transmitting members.

7. A forward facing rowing mechanism, as set forth in claim 6, wherein:

said guide means are grooves recessed in the cylindrical perimeter wall of each said sheave.

8. A forward facing rowing mechanism, as set forth in claim 1, wherein:

a first connecting stub shaft is rotatably mounted in said drive sub-assembly and a second connecting stub shaft is rotatably mounted in said driven sub-assembly;

said handle means has a gripping portion and a barrel portion;

said blade means has a blade portion and a barrel portion;

a coupling member attaches said barrel portion of said handle means to said connecting stub shaft rotatably mounted from said drive sub-assembly; and, a coupling member attaches said barrel portion of said blade means to said connecting stub shaft rotatably mounted from said driven sub-assembly.

9. A forward facing rowing mechanism, as set forth in claim 5, further comprising:

blocking means to afford a tactile indication as to when the rotational disposition of said blade portion is such as to be feathered.

10. A forward facing rowing mechanism, as set forth in claim 5, further comprising:

blocking means to afford a tactile indication as to when the rotational disposition of said blade portion is such as to be unfeathered.

11. A forward facing rowing mechanism for a boat having a bow, a longitudinal axis and a pair of gunwales comprising:

a mounting bracket adapted to be supported from each gunwale;

a tilting frame pivotally supported from said mounting bracket about an axis that is substantially parallel to the longitudinal axis of the boat;

a pair of mounting posts presented from said tilting frame and located inboard and outboard relative to each other;

said mounting posts defining first and second angular rotational axes;

a drive sub-assembly received on the inboard mounting post for rotation about said first, angular rotational axis;

handle means supported from said drive sub-assembly;

a first feathering axis extending longitudinally of said handle means;

said handle means being supported from said drive sub-assembly for rotation about said first feathering axis;

a driven sub-assembly received on the outboard mounting post for rotation about said second, angular rotational axis;

blade means supported from said driven sub-assembly;

a second feathering axis extending longitudinally of said blade means;

said blade means being supported from said driven sub-assembly for rotation about said second feathering axis;

first drive means interconnecting said drive and driven sub-assemblies so that fore and aft angular movement of said handle means to rotate said drive sub-assembly about said first angular rotational axis effects rotation of said driven sub-assembly about said second angular rotational axis to move said blade means angularly in the same fore and aft direction as said handle means;

a pair of sheaves mounted from said tilting frame;

one said sheave mounted for rotation about said first angular rotational axis and the second sheave mounted for rotation about said second angular rotational axis;

turning means mounted on said drive and driven sub-assemblies; and, second drive means employing flexible force transmitting members which are reeved about said sheaves and turning means and are operatively attached to said handle and blade means such that rotation of said handle means about said first feathering axis effects concomitant rotation of said blade means about said second feathering axis, irrespective of the angular disposition of said handle means about its angular rotational axis relative to said blade means about its angular rotational axis, for interconnecting said handle and blade means so that rotation of said handle means about said first feathering axis effects concomitant rotation of said blade means about said second feathering axis.

12. A forward facing rowing mechanism, as set forth in claim 11, wherein:

said first and second angular rotational axes are disposed, one inboard with respect to the axis about which said tilting frame pivots and one outboard with respect to the axis about which the tilting frame pivots.

13. A forward facing rowing mechanism, as set forth in claim 11, wherein:

each said drive and driven sub-assemblies has an outer wall with a curvilinear surface along at least a portion thereof;

said curvilinear portion on said drive sub-assembly being disposed in substantial opposition to said curvilinear portion on said driven sub-assembly when said sub-assemblies are disposed on said tilting frame;

said first drive means employing at least two lengths of a flexible force-transmitting member with opposite ends;

one end of each force-transmitting member being secured to said outer wall of said drive sub-assembly, and the second end of each said force transmitting member being secured to the outer wall of said driven sub-assembly;

said force-transmitting members being disposed in a crisscross pattern between said drive and driven sub-assemblies whereby rotation of said drive sub-assembly about said first, angular rotational axis effects rotation of said driven sub-assembly about said second, angular rotational axis.

14. A forward facing rowing mechanism, as set forth in claim 13, further comprising:

a first connecting stub shaft is rotatably mounted in said drive sub-assembly and a second connecting stub shaft is rotatably mounted in said driven sub-assembly;

said handle means has a gripping portion and a barrel portion;

said blade means has a blade portion and a barrel portion;

a coupling member attaches said barrel portion of said handle means to said connecting stub shaft rotatably mounted from said drive sub-assembly; and, a coupling member attaches said barrel portion of said blade means to said connecting stub shaft rotatably mounted from said driven sub-assembly.

* * * * *